US011560700B2

(12) United States Patent
Torres

(10) Patent No.: US 11,560,700 B2
(45) Date of Patent: Jan. 24, 2023

(54) FAUCET-LESS SINK ASSEMBLY

(71) Applicant: Alan Torres, Inglewood, CA (US)

(72) Inventor: Alan Torres, Inglewood, CA (US)

( * ) Notice: Subject to any disclaimer, the term of this patent is extended or adjusted under 35 U.S.C. 154(b) by 389 days.

(21) Appl. No.: 16/916,298

(22) Filed: Jun. 30, 2020

(65) Prior Publication Data

US 2021/0404157 A1 Dec. 30, 2021

(51) Int. Cl.
*E03C 1/05* (2006.01)
*E03C 1/048* (2006.01)

(52) U.S. Cl.
CPC ..... *E03C 1/052* (2013.01); *E03C 1/048* (2013.01)

(58) Field of Classification Search
CPC ..... E03C 1/052
USPC ..... 4/619
See application file for complete search history.

(56) References Cited

U.S. PATENT DOCUMENTS 1,426,046 A 8/1922 Cohen
1,448,975 A 3/1923 Nenonen
4,231,123 A 11/1980 Cheng
5,322,084 A * 6/1994 Ghiassian ..... G05G 1/305 74/529
7,305,722 B2 12/2007 Sha
7,461,419 B2 * 12/2008 Milne ..... E03C 1/0404 4/675
7,856,681 B2 12/2010 Alls
10,221,547 B2 3/2019 Gibson
2007/0061960 A1 * 3/2007 Sha ..... E03C 1/048 4/619

FOREIGN PATENT DOCUMENTS

WO WO2005054590 6/2005

* cited by examiner

*Primary Examiner* — Lauren A Crane

(57) ABSTRACT

A faucet-less sink assembly for hands-free use of a sink includes a sink bowl that is mounted to a wall of a bathroom. The sink bowl has a plurality of low pressure ports and a high pressure point each being integrated therein. A pumping unit is in fluid communication with each of the low pressure ports and the high pressure port. The pumping unit pumps a fluid into the low pressure ports to facilitate a user to wash their hands and the high pressure port for washing a personal hygiene tool. A temperature control pedal is positioned on a floor beneath the sink bowl for spraying the fluid from the low pressure ports. A high pressure pedal is positioned on the floor beneath the sink bowl for spraying fluid from the high pressure port.

14 Claims, 6 Drawing Sheets

FAUCET-LESS SINK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sink devices and more particularly pertains to a new sink device for facilitating hand-free use of a sink.

(2) Description of Related Art Including Information Disclosed Under 37 CFR 1.97 and 1.98

The prior art relates to sink devices including a variety of faucet-less sink basin devices that each has water ports integrated therein for releasing water into the sink basin. In each case of the faucet-less sink basins discloses, a fluid control valve that is manipulated by hand is included for controlling the flow of water. The prior art also discloses a faucet-less sink that has a water tube being attached thereto that surrounds the sink. The prior art discloses a sink basin that has a motion sensor for turning the sink on and off. In no instance is a faucet-less sink disclosed that includes a foot pedal for controlling the flow of water.

BRIEF SUMMARY OF THE INVENTION

An embodiment of the disclosure meets the needs presented above by generally comprising a sink bowl that is mounted to a wall of a bathroom. The sink bowl has a plurality of low pressure ports and a high pressure point each being integrated therein. A pumping unit is in fluid communication with each of the low pressure ports and the high pressure port. The pumping unit pumps a fluid into the low pressure ports to facilitate a user to wash their hands and the high pressure port for washing a personal hygiene tool. A temperature control pedal is positioned on a floor beneath the sink bowl for spraying the fluid from the low pressure ports. A high pressure pedal is positioned on the floor beneath the sink bowl for spraying fluid from the high pressure port.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
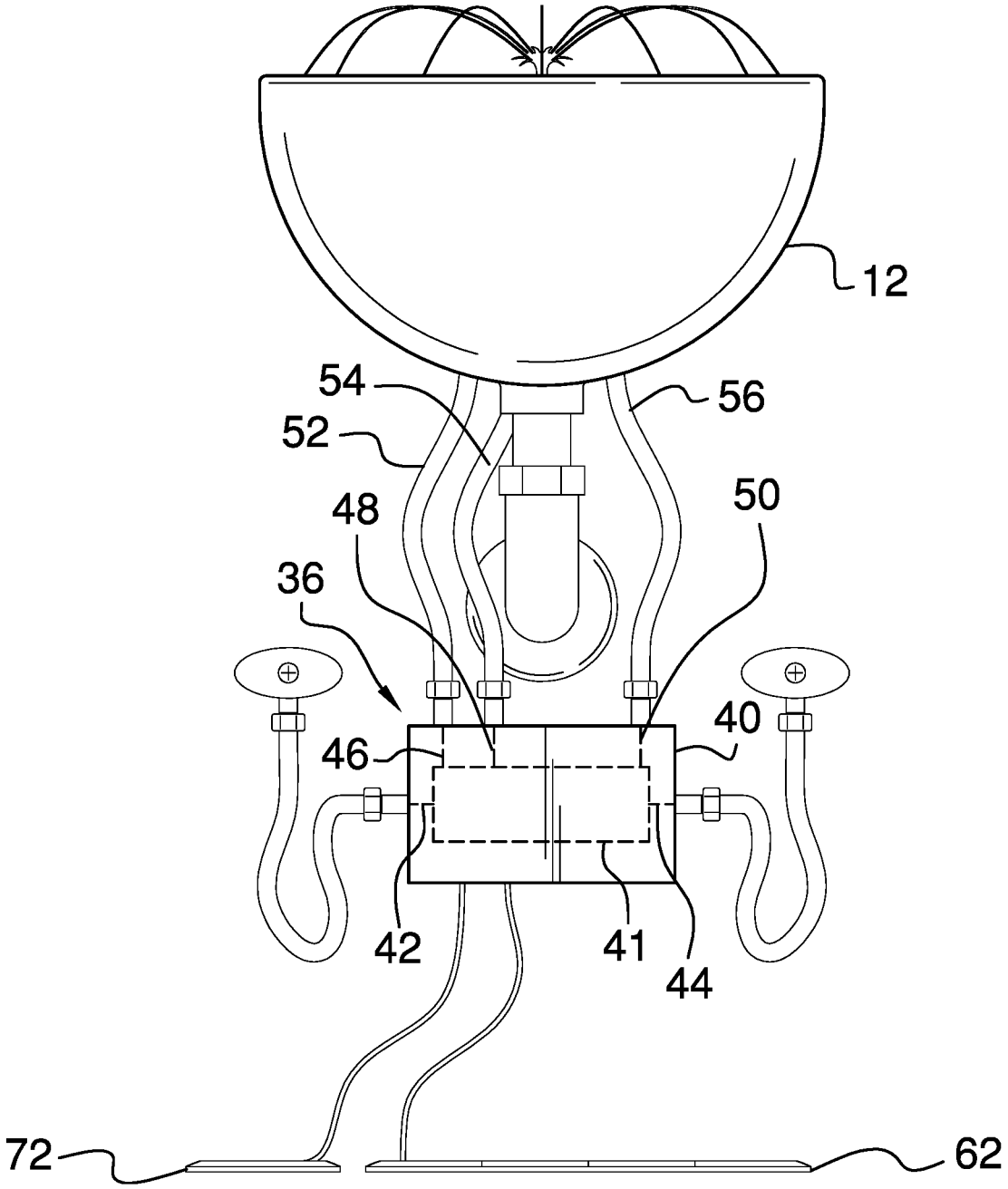
FIG. 1 is a front view of a faucet-less sink assembly according to an embodiment of the disclosure.
Figure 2:
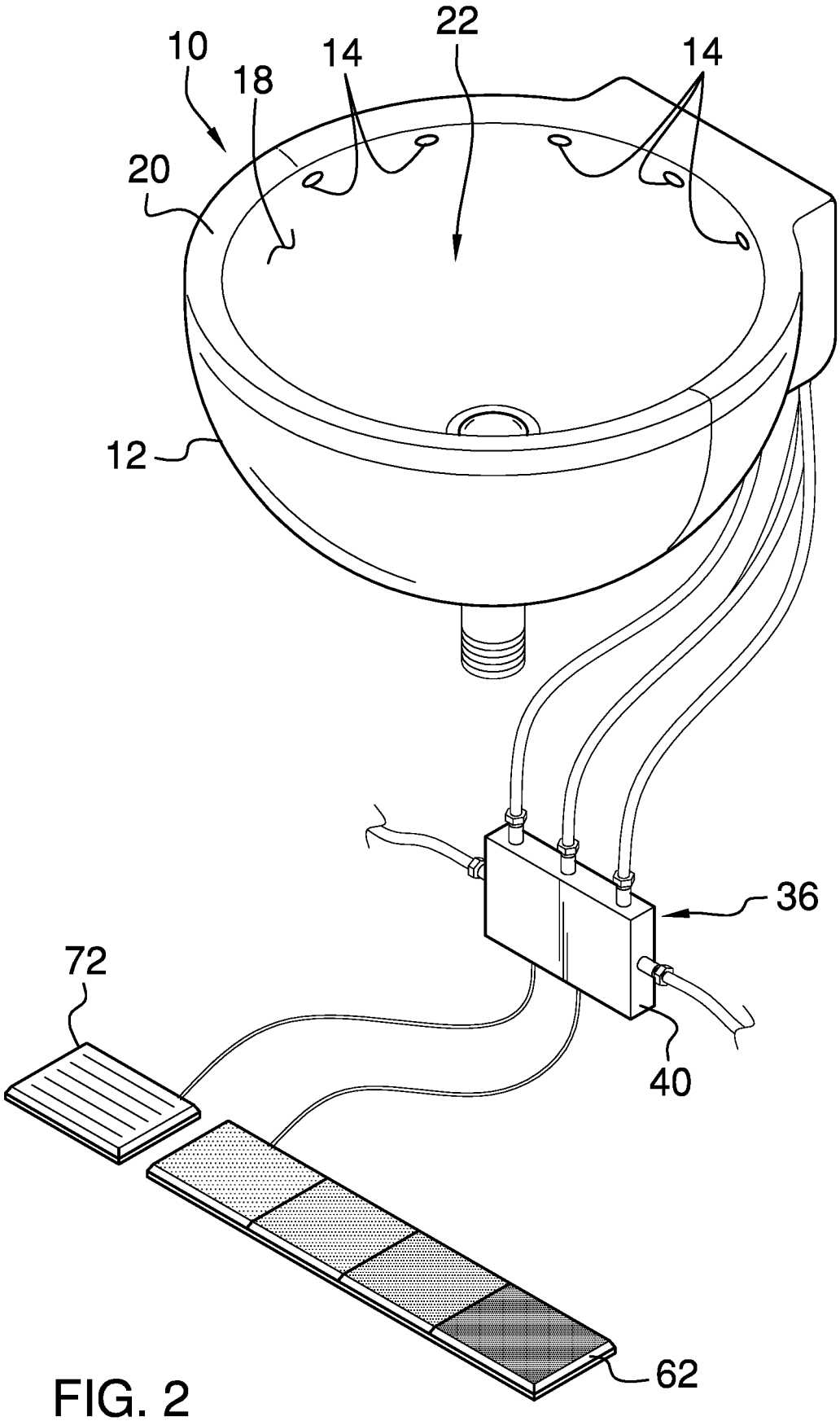
FIG. 2 is a top perspective view of an embodiment of the disclosure.
Figure 3:
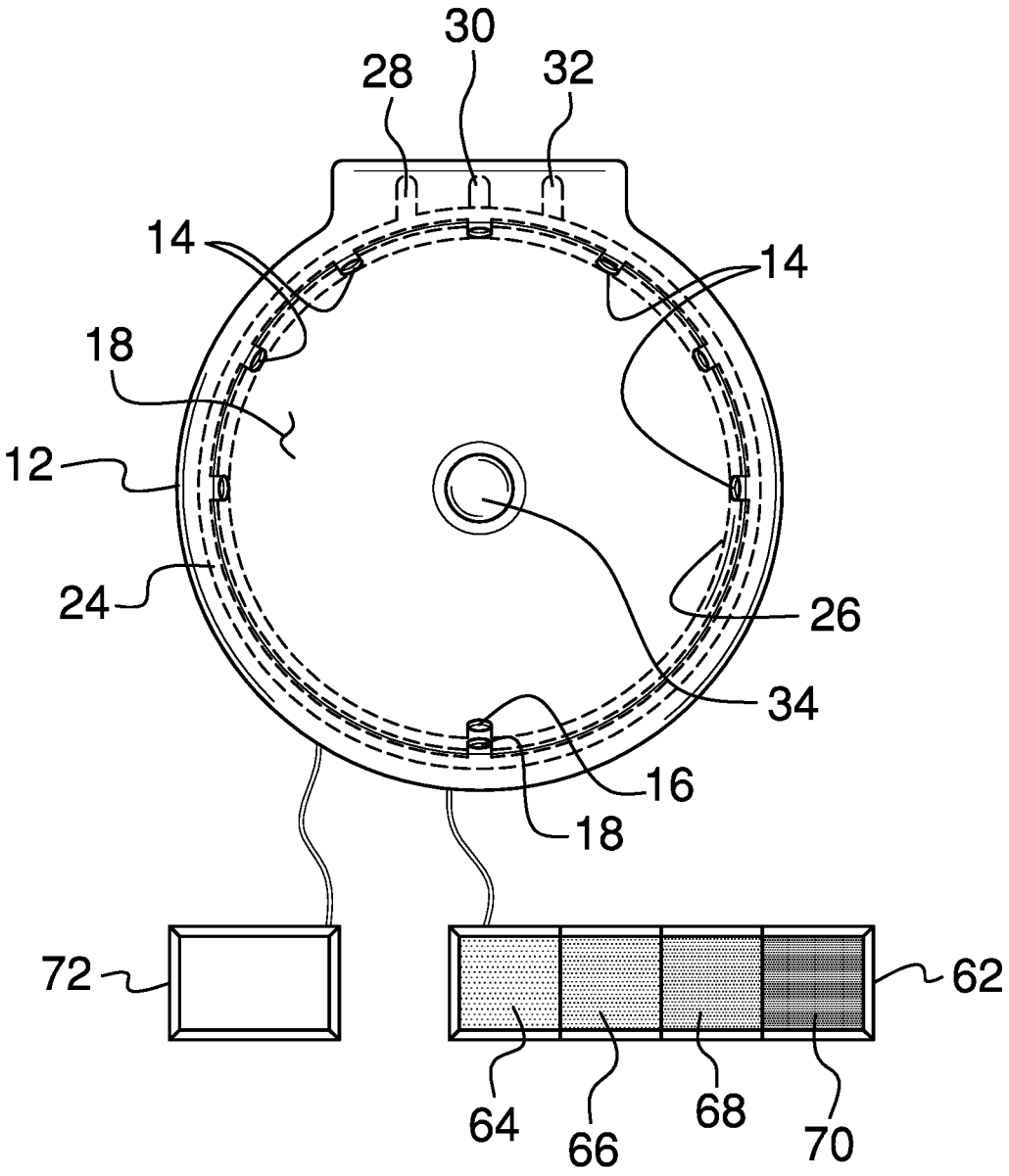
FIG. 3 is a top phantom view of an embodiment of the disclosure.
Figure 4:
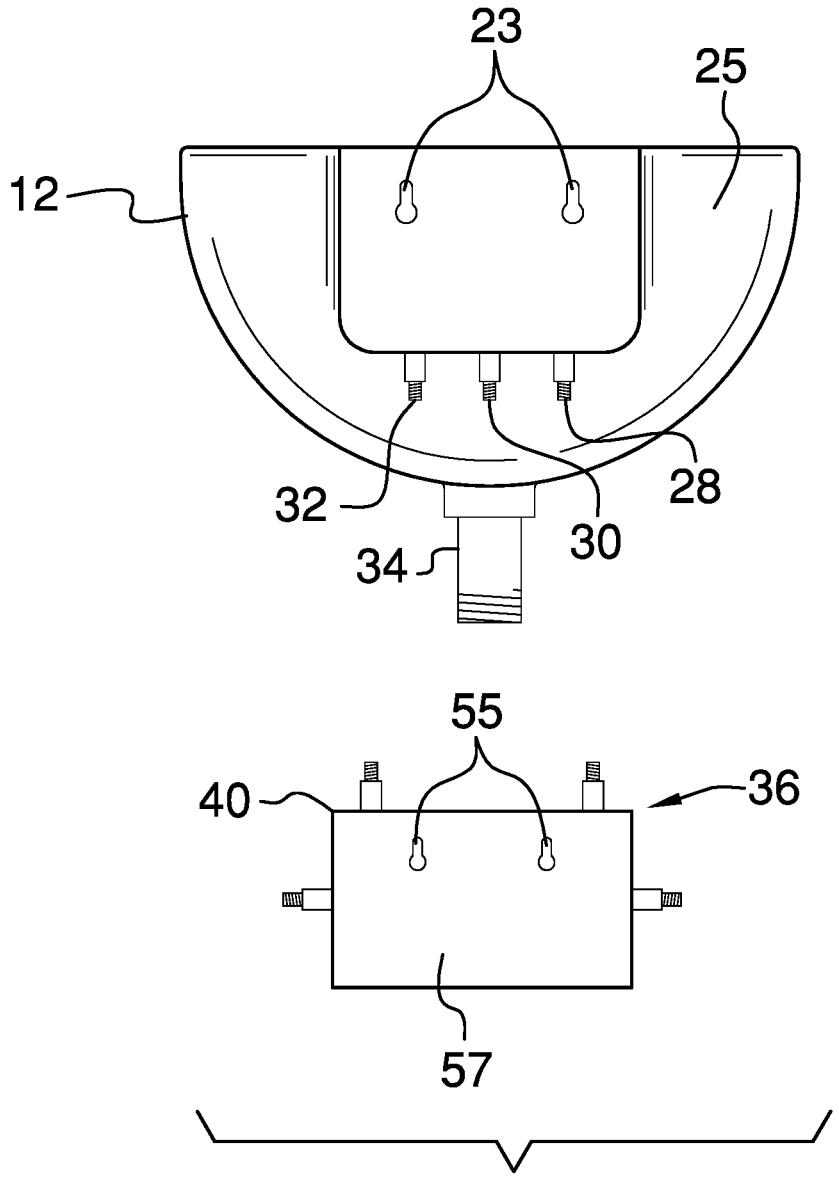
FIG. 4 is a back view of an embodiment of the disclosure.
Figure 5:
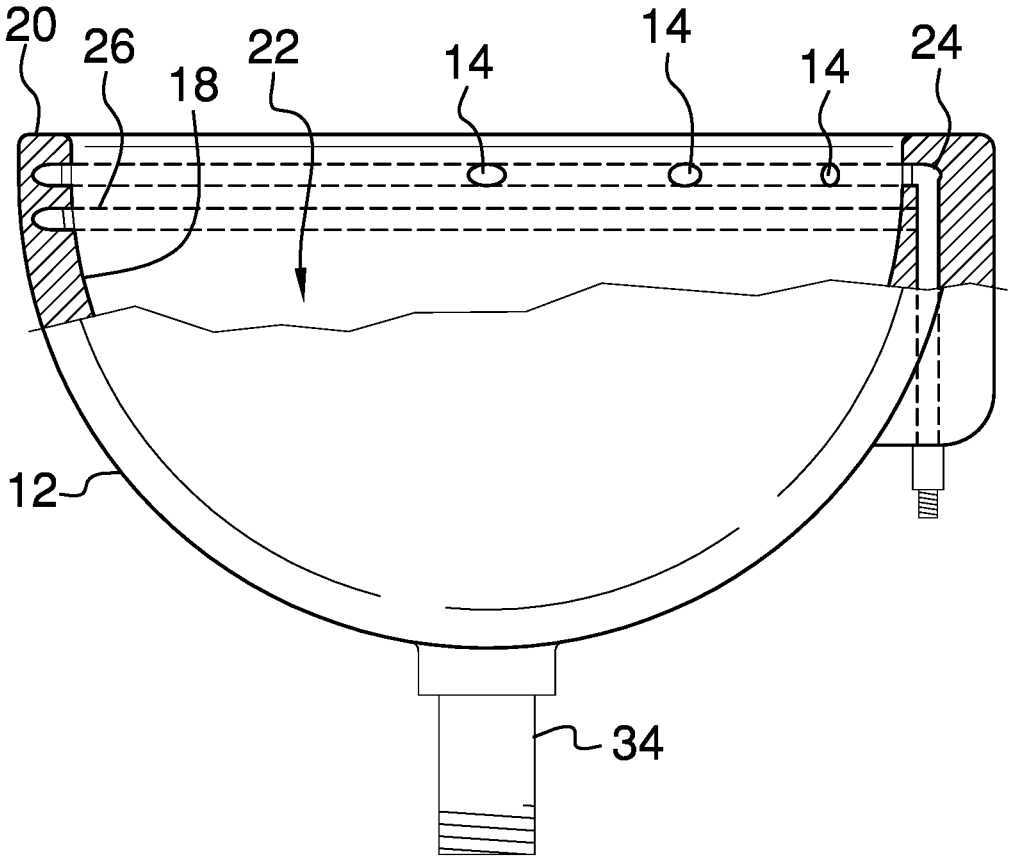
FIG. 5 is a right side cut-away view of an embodiment of the disclosure.
Figure 6:
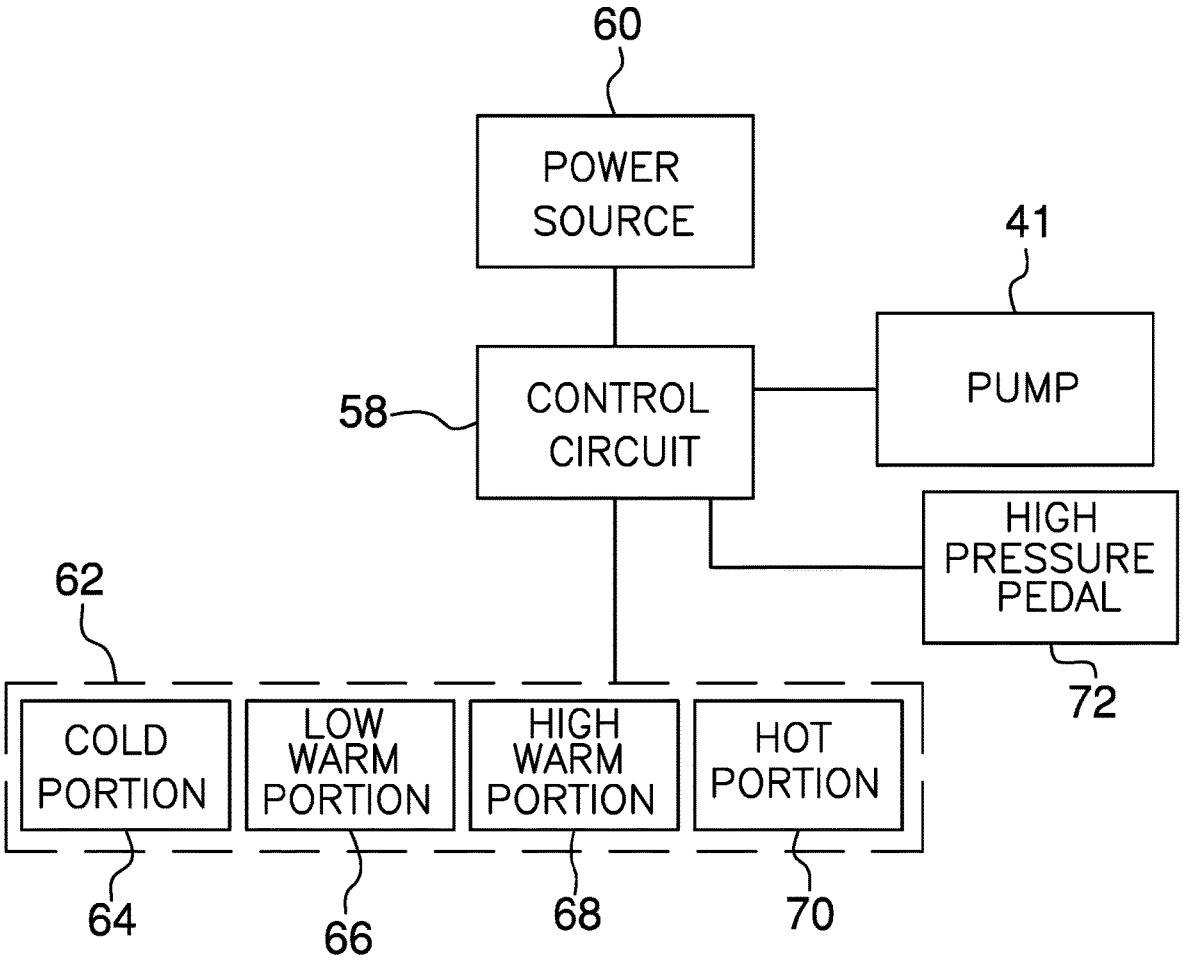
FIG. 6 is a schematic view of an embodiment of the disclosure.

With reference now to the drawings, and in particular to FIGS. 1 through 6 thereof, a new sink device embodying the principles and concepts of an embodiment of the disclosure and generally designated by the reference numeral 10 will be described.

As best illustrated in FIGS. 1 through 6, the faucet-less sink assembly 10 generally comprises as best illustrated in FIGS. 1 through 6, the faucet-less sink assembly 10 generally comprises a sink bowl 12 that is mounted to a wall of a bathroom such that the sink bowl 12 is accessible to a user of the bathroom. The sink bowl 12 has a plurality of low pressure ports 14 each being integrated therein and the low pressure ports 14 are arranged in a circle around the sink bowl 12. Additionally, the sink bowl 12 has a high pressure port 16 integrated therein. The sink bowl 12 may be structured in the convention a bathroom vanity of any conventional design, such as marble vanities, composite vanities or any other type of plumbing fixture commonly employed as a sink in a bathroom. Each of the low pressure ports 14 may be fluid nozzles that can deliver water at a maximum delivery pressure sufficiently low to inhibit the water from spraying beyond the sink bowl 12.

The sink bowl 12 has an inside surface 18 and a top edge 20 defining an opening 22 into the sink bowl 12. Each of the low pressure ports 14 extends through the inside surface 18 and each of the low pressure ports 14 is positioned adjacent to the top edge 20. Moreover, each of the low pressure ports 14 is angled upwardly with respect to the top edge 20 and each of the low pressure ports 14 is directed toward a center point of the sink bowl 12. The sink bowl 12 has a first conduit 24 integrated therein and the first conduit 24 extends around a full circumference of the sink bowl 12. The first conduit 24 is fluidly coupled to each of the low pressure ports 14. As is most clearly shown in FIG. 4, a pair of engagement slots 23 may each be recessed into a back side 25 of the sink bowl 12 for engaging a support on the wall of the bathroom to mount the sink bowl 12.

The high pressure port 16 extends through the inside surface 18 of the sink bowl 12. Additionally, the high pressure port 16 is aligned with a respective one of the low pressure ports 14 and the high pressure port 16 is spaced downwardly from the respective low pressure port 14. The sink bowl 12 has a second conduit 26 integrated therein and the second conduit 26 is in fluid communication with the high pressure port 16. Additionally, the first conduit 24 has a cold input 28 and a hot input 30, and the second conduit 26 has an inlet 32. A drain 34 is fluidly coupled to the sink bowl 12 to drain fluid from the sink bowl 12. The drain 34 is positioned at a lower apex of the sink bowl 12.

A pumping unit 36 is positioned adjacent to the sink bowl 12 and the pumping unit 36 is in fluid communication with each of the low pressure ports 14 and the high pressure port 16. The pumping unit 36 pumps a fluid into the low pressure ports 14 when the pumping unit 36 is actuated into a low pressure condition. In this way each of the low pressure ports 14 facilitates a user to wash their hands. As is most clearly shown in FIG. 1, each of the low pressure ports 14 sprays the water in an upward arc that terminates at the drain 34. In this way the user can wash their hands at any location in the sink bowl 12.

The pumping unit 36 pumps the fluid into the high pressure port 16 when the pumping unit 36 is actuated into a high pressure condition. In this way the high pressure port 16 facilitates the user to wash a personal hygiene tool. The pumping unit 36 is in fluid communication with a fluid source 38 for receiving the fluid. The fluid source 38 may be hot and cold water plumbing in the bathroom and the fluid may be hot water and cold water.

The pumping unit 36 comprises a housing 40 that is positioned beneath the sink bowl 12 and a pump 41 that is positioned within the housing 40. The pump 41 has a cold water inlet 42, a hot water inlet 44, a cold water outlet 46, a hot water outlet 48 and a high pressure outlet 50. The cold water inlet 42 is fluidly coupled to a cold water supply line 52 and the hot water inlet 44 is fluidly coupled to a hot water supply line 54. The pump 41 pumps cold water outwardly through the cold water outlet 46 when the pump 41 is actuated into a cold condition. Additionally, the pump 41 pumps hot water outwardly through the hot water outlet 48 when the pump 41 is actuated into a hot condition. The pump 41 pumps tepid water outwardly through the high pressure outlet 50 when the pump 41 is actuated into a high pressure condition. The pump 41 may be an electric fluid pump or other similar device that pumps water at a sufficient volume and pressure for use in a bathroom sink.

A cold water line 52 is fluidly coupled between the cold water outlet 46 and the cold input 28 of the first conduit 24 to deliver cold water to the first conduit 24. A hot water line 54 is fluidly coupled between the hot water outlet 48 and the hot input 30 of the first conduit 24 to deliver hot water to the first conduit 24. Additionally, a high pressure line 56 is fluidly coupled between the high pressure outlet 50 and the inlet 32 of the second conduit 26 to deliver tepid water to the second conduit 26. As is most clearly shown in FIG. 4, a pair of engagement slots 55 may each be recessed into a back side 57 of the housing 40 for engaging a support on the wall of the bathroom to mount the housing 40.

The pumping unit 36 includes a control circuit 58 that is positioned in the housing 40 and the control circuit 58 is electrically coupled to the pump 41. The control circuit 58 receives a high pressure input, a cold input, a low warm input, a high warm input and a hot input. The pump 41 is actuated into the high pressure condition when the control circuit 58 receives the high pressure input and the pump 41 is actuated into the cold condition when the control circuit 58 receives the cold input. The pump 41 is actuated into both the cold condition and the hot condition when the control circuit 58 receives either of the low warm input or the high warm input. Moreover, the pump 41 mixes a greater volume of cold water than hot water when the control circuit 58 receives the low warm input. Conversely, the pump 41 mixes a greater volume of hot water than cold water when the control circuit 58 receives the high warm input. The pump 41 is actuated into the hot condition when the control circuit 58 receives the hot input and the control circuit 58 is electrically coupled to a power source 60 comprising an electrical system of the bathroom.

A temperature control pedal 62 is provided that is positioned on a floor beneath the sink bowl 12 thereby facilitating the user to step on the temperature control pedal 62. The pumping unit 36 is actuated into the low pressure condition when the temperature control pedal 62 is stepped on. In this way the sink bowl 12 sprays the fluid to facilitate the user to wash their hands. The pumping unit 36 is turned off when the temperature control pedal 62 is not stepped on.

The temperature control pedal 62 is electrically coupled to the control circuit 58. The temperature control pedal 62 has a cold portion 64, a low warm portion 66, a high warm portion 68 and a hot portion 70. The control circuit 58 receives the cold input when the cold portion 64 is stepped on and the control circuit 58 receives the low warm input when the low warm portion 66 is stepped on. Additionally, the control circuit 58 receives the high warm input when the high warm portion 68 is stepped on and the control circuit 58 receives the hot input when the hot portion 70 is stepped on.

A high pressure pedal 72 is provided and the high pressure pedal 72 is positioned on the floor beneath the sink bowl 12 such that the user can step on the high pressure pedal 72. The pumping unit 36 is actuated into the high pressure condition when the high pressure pedal 72 is stepped on. Thus, the sink bowl 12 sprays the fluid to facilitate the personal hygiene tool to be washed. The pumping unit 36 is turned off when the high pressure pedal 72 is not stepped on. The high pressure pedal 72 is electrically coupled to the control circuit 58 and the control circuit 58 receives the high pressure input when the high pressure pedal 72 is stepped on.

In use, either the cold portion 64, the low warm portion 66, the high warm portion 68 or the hot portion 70 of the temperature control pedal 62 is stepped upon, based on the user's preference for the temperature of the water sprayed in the sink bowl 12. The water is sprayed outwardly, at the selected temperature, from the low pressure ports 14 in an upward arc thereby facilitating the user to wash their hands. In this way the user is not required to touch, with their hands, any portion of the sink bowl 12 to release the water. The water stops flowing as soon as the user is no longer stepping on the temperature control pedal 62. Additionally, the user can step on the high pressure pedal 72 to spray water from the high pressure nozzle at sufficient pressure to wash a toothbrush or other personal hygiene tool.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A faucet-less sink assembly for facilitating hands free use of a sink, said assembly comprising:

a sink bowl being mounted to a wall of a bathroom wherein said sink bowl is configured to be accessible to a user of the bathroom, said sink bowl having a plurality of low pressure ports each being integrated therein, said low pressure ports being arranged in a circle around said sink bowl, said sink bowl having a high pressure port being integrated therein;

a pumping unit being positioned adjacent to said sink bowl, said pumping unit being in fluid communication with each of said low pressure ports and said high pressure port, said pumping unit pumping a fluid into said low pressure ports when said pumping unit is actuated into a low pressure condition wherein each of said low pressure ports is configured to facilitate a user to wash their hands, said pumping unit pumping the fluid into said high pressure port when said pumping unit is actuated into a high pressure condition wherein said high pressure port is configured to facilitate the user to wash a personal hygiene tool, said pumping unit being in fluid communication with a fluid source for receiving the fluid;

a temperature control pedal being positioned on a floor beneath said sink bowl wherein said temperature control pedal is configured to be stepped on by the user, said pumping unit being actuated into said low pressure condition when said temperature control pedal is stepped on wherein said sink bowl is configured to spray the fluid to facilitate the user to wash their hands, said pumping unit being turned off when said temperature control pedal is not stepped on; and a high pressure pedal being positioned on the floor beneath said sink bowl wherein said high pressure pedal is configured to be stepped on by the user, said pumping unit being actuated into said high pressure condition when said high pressure pedal is stepped on wherein said sink bowl is configured to spray the fluid to facilitate the personal hygiene tool to be washed, said pumping unit being turned off when said high pressure pedal is not stepped on.

2. The assembly according to claim 1, wherein said sink bowl has an inside surface and a top edge defining an opening into said sink bowl, each of said low pressure ports extending through said inside surface, each of said low pressure ports being positioned adjacent to said top edge, each of said low pressure ports being angled upwardly with respect to said top edge, each of said low pressure ports being directed toward a center point of said sink bowl.

3. The assembly according to claim 2, wherein said sink bowl has a first conduit being integrated therein, said first conduit extending around a full circumference of said sink bowl, said first conduit being fluidly coupled to each of said low pressure ports.

4. The assembly according to claim 2, wherein said sink bowl has a high pressure port being integrated therein, said high pressure port extending through said inside surface of said sink bowl, said high pressure port being aligned with a respective one of said low pressure ports, said high pressure port being spaced downwardly from said respective low pressure port.

5. The assembly according to claim 4, wherein:

said sink bowl has a first conduit being integrated therein; and said sink bowl has a second conduit being integrated therein, said second conduit being in fluid communication with said high pressure port, said first conduit having a cold input and a hot input, said second conduit having an inlet.

6. The assembly according to claim 1, wherein:

said sink bowl has a first conduit being integrated therein, said first conduit extending around a full circumference of said sink bowl, said first conduit being fluidly coupled to each of said low pressure ports;

said sink bowl has a second conduit being integrated therein, said second conduit being in fluid communication with said high pressure port, said first conduit having a cold input and a hot input, said second conduit having an inlet; and said pumping unit comprises:

a housing being positioned beneath said sink bowl;

a pump being positioned within said housing, said pump having a cold water inlet, said pump having a hot water inlet, said pump having a cold water outlet, said pump having a hot water outlet, said pump having a high pressure outlet, said cold water inlet being fluidly coupled to a cold water supply line, said hot water inlet being fluidly coupled to a hot water supply line, said pump pumping cold water outwardly through said cold water outlet when said pump is actuated into a cold condition, said pump pumping hot water outwardly through said hot water outlet when said pump is actuated into a hot condition, said pump pumping tepid water outwardly through said high pressure outlet when said pump is actuated into a high pressure condition.

7. The assembly according to claim 6, wherein said pumping unit includes a cold water line being fluidly coupled between said cold water outlet and said cold input of said first conduit wherein said cold water line is configured to deliver cold water to said first conduit.

8. The assembly according to claim 6, wherein said pumping unit includes a hot water line being fluidly coupled between said hot water outlet and said hot input of said first conduit wherein said hot water line is configured to deliver hot water to said first conduit.

9. The assembly according to claim 6, wherein said pumping unit includes a high pressure line being fluidly coupled between said high pressure outlet and said inlet of said second conduit wherein said high pressure line is configured to deliver tepid water to said second conduit.

10. The assembly according to claim 6, wherein said pumping unit includes a control circuit being positioned in said housing, said control circuit being electrically coupled to said pump, said control circuit receiving a high pressure input, said control circuit receiving a cold input, said control circuit receiving a low warm input, said control circuit receiving a high warm input, said control circuit receiving a hot input.

11. The assembly according to claim 10, wherein:

said pump is actuated into said high pressure condition when said control circuit receives said high pressure input;

said pump is actuated into said cold condition when said control circuit receives said cold input;

said pump is actuated into both said cold condition and said hot condition when said control circuit receives either of said low warm input or said high warm input;

said pump is actuated into said hot condition when said control circuit receives said hot input; and said control circuit is electrically coupled to a power source comprising an electrical system of the bathroom.

12. The assembly according to claim 11, wherein said temperature control pedal is electrically coupled to said control circuit, said temperature control pedal having a cold portion, a low warm portion, a high warm portion and a hot portion, said control circuit receiving said cold input when said cold portion is stepped on, said control circuit receiving said low warm input when said low warm portion is stepped on, said control circuit receiving said high warm input when said high warm portion is stepped on, said control circuit receiving said hot input when said hot portion is stepped on.

13. The assembly according to claim 11, wherein said high pressure pedal is electrically coupled to said control circuit, said control circuit receiving said high pressure input when said high pressure pedal is stepped on.

14. A faucet-less sink assembly for facilitating hands free use of a sink, said assembly comprising:

a sink bowl being mounted to a wall of a bathroom wherein said sink bowl is configured to be accessible to a user of the bathroom, said sink bowl having a plurality of low pressure ports each being integrated therein, said low pressure ports being arranged in a circle around said sink bowl, said sink bowl having a high pressure port being integrated therein, said sink bowl having an inside surface and a top edge defining an opening into said sink bowl, each of said low pressure ports extending through said inside surface, each of said low pressure ports being positioned adjacent to said top edge, each of said low pressure ports being angled upwardly with respect to said top edge, each of said low pressure ports being directed toward a center point of said sink bowl, said sink bowl having a first conduit being integrated therein, said first conduit extending around a full circumference of said sink bowl, said first conduit being fluidly coupled to each of said low pressure ports, said sink bowl having a high pressure port being integrated therein, said high pressure port extending through said inside surface of said sink bowl, said high pressure port being aligned with a respective one of said low pressure ports, said high pressure port being spaced downwardly from said respective low pressure port, said sink bowl having a second conduit being integrated therein, said second conduit being in fluid communication with said high pressure port, said first conduit having a cold input and a hot input, said second conduit having an inlet;

a drain being fluidly coupled to said sink bowl wherein said drain is configured to drain fluid from said sink bowl, said drain being positioned at a lower apex of said sink bowl;

a pumping unit being positioned adjacent to said sink bowl, said pumping unit being in fluid communication with each of said low pressure ports and said high pressure port, said pumping unit pumping a fluid into said low pressure ports when said pumping unit is actuated into a low pressure condition wherein each of said low pressure ports is configured to facilitate a user to wash their hands, said pumping unit pumping the fluid into said high pressure port when said pumping unit is actuated into a high pressure condition wherein said high pressure port is configured to facilitate the user to wash a personal hygiene tool, said pumping unit being in fluid communication with a fluid source for receiving the fluid, said pumping unit comprising:

a housing being positioned beneath said sink bowl;

a pump being positioned within said housing, said pump having a cold water inlet, said pump having a hot water inlet, said pump having a cold water outlet, said pump having a hot water outlet, said pump having a high pressure outlet, said cold water inlet being fluidly coupled to a cold water supply line, said hot water inlet being fluidly coupled to a hot water supply line, said pump pumping cold water outwardly through said cold water outlet when said pump is actuated into a cold condition, said pump pumping hot water outwardly through said hot water outlet when said pump is actuated into a hot condition, said pump pumping tepid water outwardly through said high pressure outlet when said pump is actuated into a high pressure condition;

a cold water line being fluidly coupled between said cold water outlet and said cold input of said first conduit wherein said cold water line is configured to deliver cold water to said first conduit;

a hot water line being fluidly coupled between said hot water outlet and said hot input of said first conduit wherein said hot water line is configured to deliver hot water to said first conduit;

a high pressure line being fluidly coupled between said high pressure outlet and said inlet of said second conduit wherein said high pressure line is configured to deliver tepid water to said second conduit; and a control circuit being positioned in said housing, said control circuit being electrically coupled to said pump, said control circuit receiving a high pressure input, said control circuit receiving a cold input, said control circuit receiving a low warm input, said control circuit receiving a high warm input, said control circuit receiving a hot input, said pump being actuated into said high pressure condition when said control circuit receives said high pressure input, said pump being actuated into said cold condition when said control circuit receives said cold input, said pump being actuated into both said cold condition and said hot condition when said control circuit receives either of said low warm input or said high warm input, said pump being actuated into said hot condition when said control circuit receives said hot input, said control circuit being electrically coupled to a power source comprising an electrical system of the bathroom;

a temperature control pedal being positioned on a floor beneath said sink bowl wherein said temperature control pedal is configured to be stepped on by the user, said pumping unit being actuated into said low pressure condition when said temperature control pedal is stepped on wherein said sink bowl is configured to spray the fluid to facilitate the user to wash their hands, said pumping unit being turned off when said temperature control pedal is not stepped on, said temperature control pedal being electrically coupled to said control circuit, said temperature control pedal having a cold portion, a low warm portion, a high warm portion and a hot portion, said control circuit receiving said cold input when said cold portion is stepped on, said control circuit receiving said low warm input when said low warm portion is stepped on, said control circuit receiving said high warm input when said high warm portion is stepped on, said control circuit receiving said hot input when said hot portion is stepped on; and a high pressure pedal being positioned on the floor beneath said sink bowl wherein said high pressure pedal is configured to be stepped on by the user, said pumping unit being actuated into said high pressure condition when said high pressure pedal is stepped on wherein said sink bowl is configured to spray the fluid to facilitate the personal hygiene tool to be washed, said pumping unit being turned off when said high pressure pedal is not stepped on, said high pressure pedal being electrically coupled to said control circuit, said control circuit receiving said high pressure input when said high pressure pedal is stepped on.

* * * * *